US007805956B2

(12) United States Patent
Kwon

(10) Patent No.: US 7,805,956 B2
(45) Date of Patent: Oct. 5, 2010

(54) ADDITIVE-STORING TANK ASSEMBLY AND REFRIGERATOR HAVING THE SAME

(75) Inventor: Yong Chol Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 976 days.

(21) Appl. No.: 11/373,336

(22) Filed: Mar. 13, 2006

(65) Prior Publication Data

US 2006/0230779 A1 Oct. 19, 2006

(30) Foreign Application Priority Data

Mar. 14, 2005 (KR) ..... 10-2005-0021147

(51) Int. Cl.
*F25D 3/00* (2006.01)

(52) U.S. Cl. ..... 62/389; 137/205.5; 222/146.6; 222/617; 251/318; 251/321; 251/323; 251/336; 251/337

(58) Field of Classification Search ..... 137/205.5; 222/173, 617, 180, 132, 135
See application file for complete search history.

(56) References Cited

U.S. PATENT DOCUMENTS

| | | | | |
|---|---|---|---|---|
| 5,071,070 | A * | 12/1991 | Hardy | 239/311 |
| 5,766,660 | A * | 6/1998 | Lee et al. | 426/118 |
| 2004/0187516 | A1 * | 9/2004 | Lee | 62/389 |
| 2005/0258082 | A1 * | 11/2005 | Lund et al. | 210/101 |

* cited by examiner

*Primary Examiner*—Cheryl J Tyler
*Assistant Examiner*—Justin Loffredo
(74) *Attorney, Agent, or Firm*—Ked & Associates LLP

(57) ABSTRACT

An additive-storing tank assembly includes: a tank body having an additive-storing space defined in the tank body, in which an additive is stored; a plunger-holding tube provided at one side of the tank body in order to connect the additive-storing space with a water supply pipe for supplying water to a dispenser of a refrigerator; and an opening/closing means for selectively connecting the additive-storing space with the water supply pipe so that the additive stored in the additive-storing space is dissolved in the water flowing through the water supply pipe.

16 Claims, 3 Drawing Sheets

ADDITIVE-STORING TANK ASSEMBLY AND REFRIGERATOR HAVING THE SAME

BACKGROUND OF THE INVENTION

1. Field of the invention

The present invention relates to a refrigerator, and more particularly to an additive-storing tank assembly for putting an additive, such as carbonic acid gas, into water dispensed from a dispenser and a refrigerator having the same.

2. Description of the Prior Art

FIG. 1 illustrates an internal structure of a conventional refrigerator.

As shown, the conventional refrigerator has a storage space defined in a refrigerator body 1, which is partitioned into a freezer compartment and a fresh food compartment disposed at left and right sides, respectively. The freezer compartment and the fresh food compartment are selectively opened and closed by a freezer compartment door 3 and a fresh food compartment door 5, respectively.

A filter 7 is mounted inside of the refrigerator body 1. The filter 7 filters water supplied through a first water supply pipe p1 from an external water source (WS). The first water supply pipe p1 is equipped with a first valve v1 for regulating the quantity of the water supplied to the filter 7 from the water source.

A water tank 9 is installed in the fresh food compartment. The water tank 9 stores the water supplied through a second water supply pipe p2 after being filtered by the filter 7. The water stored in the water tank 9 is maintained at a low temperature by the cool air in the fresh food compartment. The second water supply pipe p2 is equipped with a second valve v2 for regulating the quantity of the water supplied to the water tank 9 after being filtered by the filter 7.

The cool water stored in the water tank 9 is transferred through a third water supply pipe p3 to a dispenser 11 disposed at the front surface of the freezer compartment door 3. Further, according to the operation of the dispenser 11, the cool water stored in the water tank 9 is transferred through the third water supply pipe p3 to the dispenser 11 and is then dispensed out of the dispenser 11.

In the meantime, the freezer compartment is equipped with an ice maker 13 which produces ice by using the water supplied through a fourth water supply pipe p4 after being filtered by the filter 7 and then supplies the produced ice to the dispenser 11. The fourth water supply pipe p4 is branched from a portion of the first water supply pipe p1 between the filter 7 and the water tank 9. The fourth water supply pipe p4 is equipped with a third valve v3 for regulating the quantity of the water supplied to the ice maker 13 after being filtered by the filter 7.

However, the conventional refrigerator having the above-mentioned structure has the following problems.

In the conventional refrigerator as described above, the water from the water source is simply dispensed out through the dispenser 11 after being filtered by the filter 7 and then cooled in the water tank 9. However, the conventional refrigerator cannot provide water having various savors and flavors according to users' tastes.

SUMMARY OF THE INVENTION

Accordingly, the present invention has been made to solve the above-mentioned problems occurring in the prior art, and an object of the present invention is to provide an additive-storing tank assembly and a refrigerator having the same, which can dispense water with various added flavors and fragrance through a dispenser.

In order to accomplish this object, there is provided an additive-storing tank assembly comprising: a tank body having an additive-storing space defined in the tank body, in which an additive is stored; a plunger-holding tube provided at one side of the tank body in order to connect the additive-storing space with a water supply pipe for supplying water to a dispenser of a refrigerator; and an opening/closing means for selectively connecting the additive-storing space with the water supply pipe so that the additive stored in the additive-storing space is dissolved in the water flowing through the water supply pipe.

Preferably, the additive-storing tank assembly may further comprise a mounting bracket having a shape of a hollow cylinder having one open end, which is provided at and connected to the water supply pipe, wherein the plunger-holding tube has a shape of a hollow cylinder which has an outer diameter and a length corresponding to an inner diameter and a length of the mounting bracket, both ends of the plunger-holding tube are open, and the plunger-holding tube is inserted in the mounting bracket, so that the additive stored in the additive-storing space is dissolved in the water when the water flowing through the water supply pipe passes through the plunger-holding tube, and the dissolved additive-containing water is then transferred to the dispenser.

The mounting bracket may have an inlet port for introducing the water from the water supply pipe and an outlet port for discharging the water to the water supply pipe, and the plunger-holding tube has an inlet port and an outlet port connected with the inlet port and the outlet port of the mounting bracket, respectively.

Preferably, the opening/closing means may comprise a plunger having a shape of a cylinder having an outer diameter corresponding to an inner diameter of the plunger-holding tube, the plunger being longer than the plunger-holding tube, the plunger being inserted in the plunger-holding tube in such a manner that the plunger is movable in a longitudinal direction in the plunger-holding tube, the plunger having a fluid channel formed in the plunger, the fluid channel connecting the additive-storing space with the inlet port and the outlet port of the plunger-holding tube only when the plunger is located at a predetermined position in the plunger-holding tube; and an elastic member for applying elastic force to the plunger so as to move the plunger toward a position at which the fluid channel is not connected with the inlet port and the outlet port of the plunger-holding tube and the plunger blocks the additive-storing space from the inlet port and the outlet port of the plunger-holding tube, wherein, when the plunger-holding tube is inserted in the mounting bracket, the plunger is pushed against the elastic force of the elastic member by a portion of the mounting bracket, so that the additive-storing space is connected with the inlet port and the outlet port of the plunger-holding tube through the fluid channel.

Preferably, a spring seat for seating the elastic member is formed on an inner cylindrical surface of the plunger-holding tube; a guide rib is provided on a portion of an outer cylindrical surface of the plunger, so that the guide rib moves within the spring seat when the plunger moves in a longitudinal direction of the plunger-holding tube; and the elastic member includes a coil spring having both ends held by one end of the spring seat and one side of the guide rib.

The additive-storing tank assembly may further comprise a locking means for preventing the plunger-holding tube from being unintentionally separated after being assembled with the mounting bracket.

Preferably, the locking means may comprise a locking flange extending radially outward from the open end of the mounting bracket and having a plurality of locking hooks formed at a rim of the locking flange, the locking hooks being spaced apart a predetermined interval along the rim of the locking flange; and a locking plate extending radially outward from a portion of an outer cylindrical surface of the plunger-holding tube and having a plurality of locking holes corresponding to the locking hooks, wherein, when the locking plate is inserted into the locking flange by passing the locking hooks the locking holes and is then rotated a predetermined angle, the locking hooks are engaged with the locking plate, so as to prevent the plunger-holding tube from being unintentionally separated from the mounting bracket.

The additive-storing tank assembly may further comprise a sealing means for sealing clearance between the mounting bracket and the plunger-holding tube.

Preferably, the sealing means comprises a sealing ring inserted in sealing grooves formed on the mounting bracket and the plunger-holding tube, which are opposed to each other.

More preferably, the additive stored in the additive-storing space includes carbonic acid gas.

According to another aspect of the present invention, there is a filter for filtering water supplied through a first water supply pipe from an external water source; a water tank for storing and cooling the water supplied through a second water supply pipe after being filtered by the filter; and an additive-storing tank assembly assembled with a third water supply pipe for supplying the water from the water tank to a dispenser so that additive stored in the additive-storing tank assembly is dissolved in the water flowing through the third water supply pipe.

The refrigerator may further comprise an ice maker for supplying ice to the dispenser after producing the ice by using the water supplied through a fourth water supply pipe after being filtered by the filter, the fourth water supply pipe being branched off from the second water supply pipe.

According to a further aspect of the present invention, there is a first water supply pipe through which water supplied from an external water source flows; a filter for filtering the water supplied through the first water supply pipe; a second water supply pipe through which the water filtered by the filter flows; a water tank for storing and cooling the water supplied through second water supply pipe after being filtered by the filter; a third water supply pipe through which the water from the water tank flows; an additive-storing tank assembly for storing additive which will be dissolved in the water flowing through the third water supply pipe from the water tank; a dispenser for storing and dispensing the additive-containing water supplied through the third water supply pipe; a fourth water supply pipe through which the water flows after being filtered by the filter, the fourth water supply pipe being branched off from the second water supply pipe; and an ice maker from supplying ice to the dispenser after producing the ice by using water supplied through the fourth water supply pipe, which a part of the water filtered by the filter.

Preferably, the first water supply pipe is equipped with a first valve for regulating a quantity of the water supplied to the filter from the water source.

Preferably, the third water supply pipe is equipped with a second valve for regulating a quantity of the water supplied to the dispenser, in which the additive is dissolved.

More preferably, the fourth water supply pipe is provided with a third valve for regulating a quantity of the water supplied to the ice maker after being filtered by the filter.

The additive-storing tank assembly may be assembled with a portion of the third water supply pipe adjacent to the water tank.

The additive-storing tank assembly may comprise a tank body having an additive-storing space defined in the tank body, in which an additive is stored; a plunger-holding tube provided at one side of the tank body in order to connect the additive-storing space with the third water supply; and an opening/closing means for selectively connecting the additive-storing space with the third water supply pipe so that the additive stored in the additive-storing space is dissolved in the water flowing through the third water supply pipe.

The refrigerator may further comprise a mounting bracket having a shape of a hollow cylinder having one open end, which is provided at and connected to the third water supply pipe, wherein the plunger-holding tube has a shape of a hollow cylinder which has an outer diameter and a length corresponding to an inner diameter and a length of the mounting bracket, both ends of the plunger-holding tube are open, and the plunger-holding tube is inserted in the mounting bracket, so that the additive stored in the additive-storing space is dissolved in the water when the water flowing through the third water supply pipe passes through the plunger-holding tube, and the dissolved additive-containing water is then transferred to the dispenser.

Preferably, the mounting bracket has an inlet port for introducing the water from the third water supply pipe and an outlet port for discharging the water to the third water supply pipe, and the plunger-holding tube has an inlet port and an outlet port connected with the inlet port and the outlet port of the mounting bracket, respectively.

The opening/closing means may comprise a plunger having a shape of a cylinder having an outer diameter corresponding to an inner diameter of the plunger-holding tube, the plunger being longer than the plunger-holding tube, the plunger being inserted in the plunger-holding tube in such a manner that the plunger is movable in a longitudinal direction in the plunger-holding tube, the plunger having a fluid channel formed in the plunger, the fluid channel connecting the additive-storing space with the inlet port and the outlet port of the plunger-holding tube only when the plunger is located at a predetermined position in the plunger-holding tube; and an elastic member for applying elastic force to the plunger so as to move the plunger toward a position at which the fluid channel is not connected with the inlet port and the outlet port of the plunger-holding tube and the plunger blocks the additive-storing space from the inlet port and the outlet port of the plunger-holding tube, wherein, when the plunger-holding tube is inserted in the mounting bracket, the plunger is pushed against the elastic force of the elastic member by a portion of the mounting bracket, so that the additive-storing space is connected with the inlet port and the outlet port of the plunger-holding tube through the fluid channel. a spring seat for seating the elastic member is formed on an inner cylindrical surface of the plunger-holding tube;

Preferably, a guide rib is provided on a portion of an outer cylindrical surface of the plunger, so that the guide rib moves within the spring seat when the plunger moves in a longitudinal direction of the plunger-holding tube; and the elastic member includes a coil spring having both ends held by one end of the spring seat and one side of the guide rib.

The refrigerator may further comprise a locking means for preventing the plunger-holding tube from being unintentionally separated after being assembled with the mounting bracket.

The locking means may comprise a locking flange extending radially outward from the open end of the mounting bracket and having a plurality of locking hooks formed at a rim of the locking flange, the locking hooks being spaced apart a predetermined interval along the rim of the locking flange; and a locking plate extending radially outward from a portion of an outer cylindrical surface of the plunger-holding tube and having a plurality of locking holes corresponding to the locking hooks, wherein, when the locking plate is inserted into the locking flange by passing the locking hooks the locking holes and is then rotated a predetermined angle, the locking hooks are engaged with the locking plate, so as to prevent the plunger-holding tube from being unintentionally separated from the mounting bracket.

Preferably, the refrigerator may further comprise a sealing means for sealing clearance between the mounting bracket and the plunger-holding tube.

The sealing means may comprise a sealing ring inserted in sealing grooves formed on the mounting bracket and the plunger-holding tube, which are opposed to each other.

Preferably, the additive stored in the additive-storing space may include carbonic acid gas.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, an additive-storing tank assembly and a refrigerator having the tank assembly according to a preferred embodiment of the present invention will be described in detail with reference to the accompanying drawings.

Figure 1:
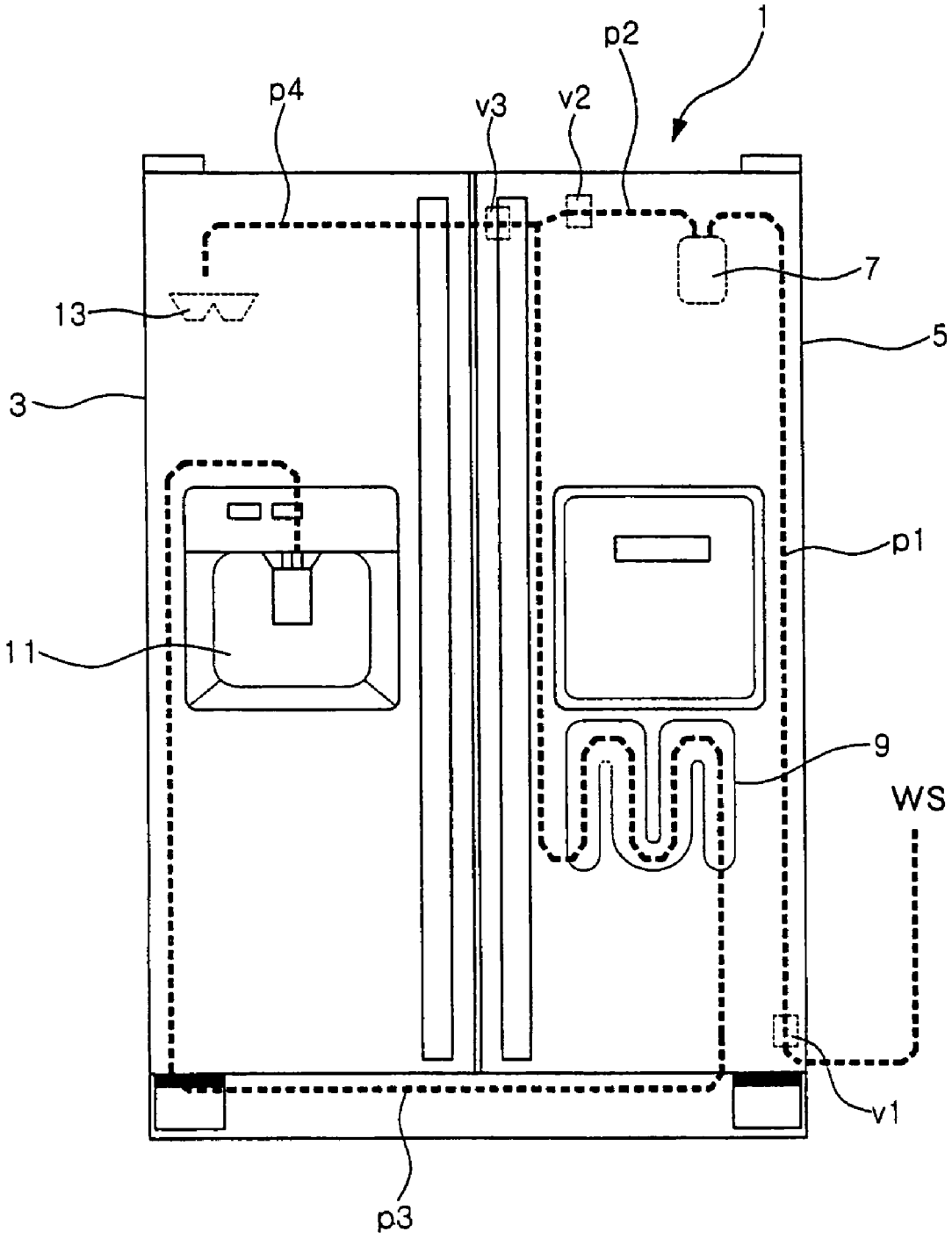
FIG. 1 is a front view of a conventional refrigerator, which illustrates an internal structure thereof.
Figure 2:
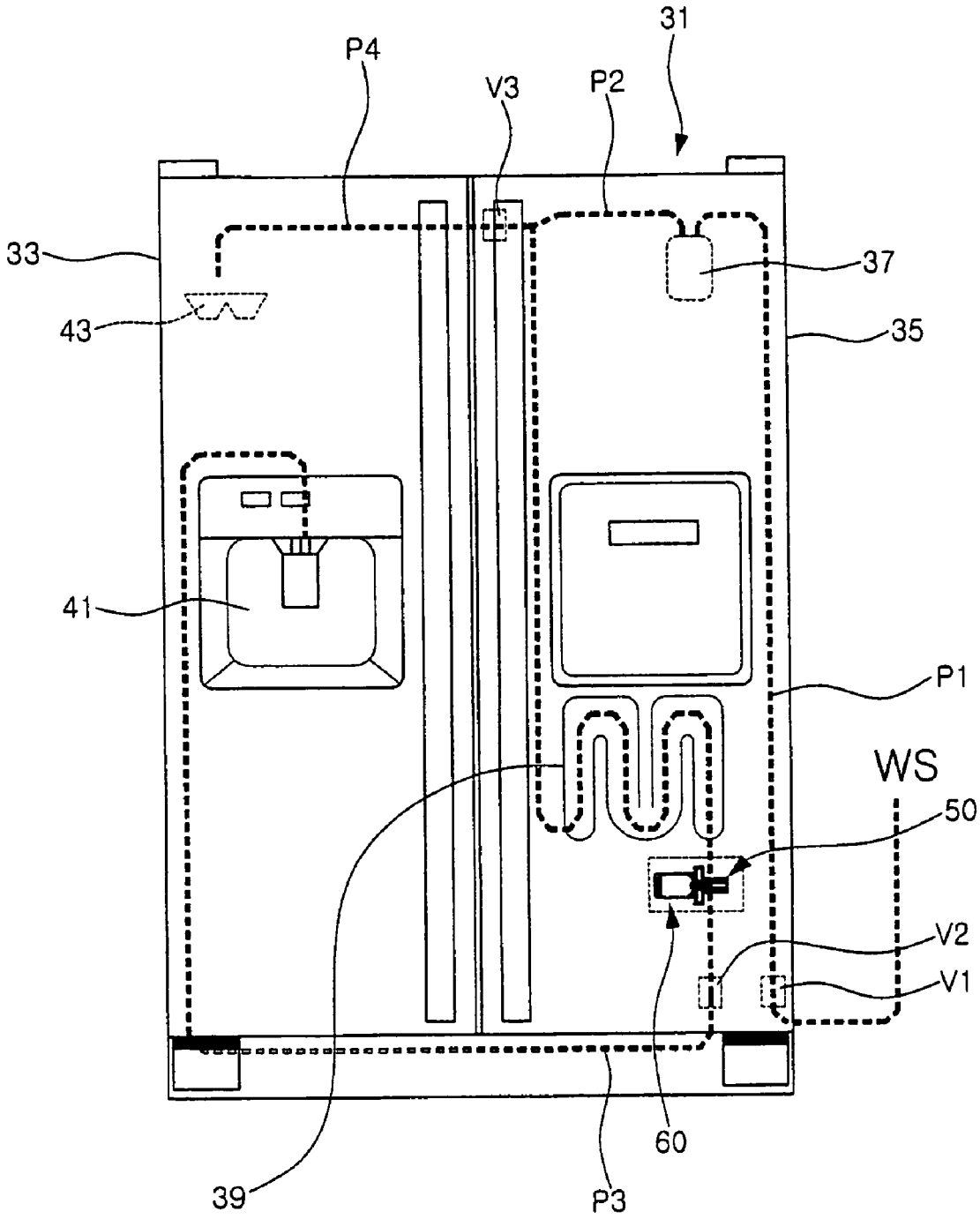
FIG. 2 is a front view of a refrigerator having an additive-storing tank assembly according to a preferred embodiment of the present invention, which illustrates an internal structure thereof.
Figure 3:
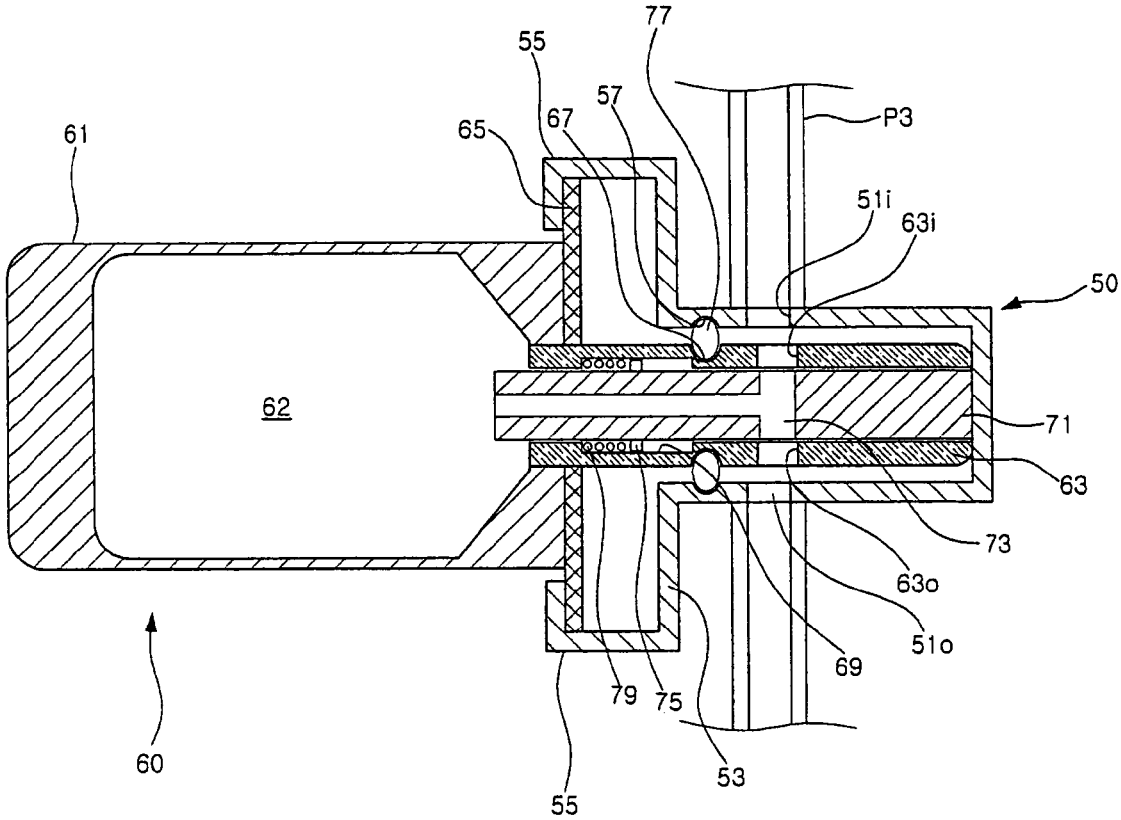
FIG. 3 is a sectional view of an additive-storing tank assembly assembled with a mounting bracket in the refrigerator shown in FIG. 2.

FIG. 2 is a front view of a refrigerator having an additive-storing tank assembly according to an embodiment of the present invention, and FIG. 3 is a sectional view of the additive-storing tank assembly installed in the refrigerator shown in FIG. 2.

As shown, a storage space is defined in a refrigerator body 31. Although the storage space in the refrigerator shown in FIG. 2 is partitioned into left and right sides for a freezer compartment and a fresh food compartment, respectively, it is possible to partition the storage space into upper and lower sides. The freezer compartment and the fresh food compartment are opened or closed by a freezer compartment door 33 and a fresh food compartment door 35, respectively, which are rotatably assembled with the refrigerator body 31.

A filter 37 is installed in the refrigerator body 31. Water is supplied from an external water source (WS) through a first water supply pipe p1 to the filter 37. The filter 37 filters the water supplied from the water source.

The first water supply pipe p1 is provided with a first valve v1 for regulating the quantity of the water supplied to the filter 37 from the water source.

A water tank 39 is installed in the fresh food compartment. The water tank 39 stores the water supplied through a second water supply pipe p2 after being filtered by the filter 37. The water stored in the water tank 39 is maintained at a low temperature by the cooling air circulating in the fresh food compartment.

The water stored in the water tank 39 is supplied to a dispenser 41 through a third water supply pipe p3. The dispenser 41 is installed at a portion of the front surface of the freezer compartment door 33. According to user's operation, the dispenser 41 dispenses the water supplied through the third water supply pipe p3 from the water tank 39.

The third water supply pipe p3 is equipped with a second valve v2 for regulating the quantity of the water supplied to the dispenser 41 from the filter 37.

An ice maker 43 is installed in the freezer compartment. The ice maker 43 receives the water supplied through a fourth water supply pipe p4 after being filtered by the filter 37 and produces ice from the received water. To this end, the fourth water supply pipe p4 is branched from a portion of the second water supply pipe p2, specifically, a portion of the second water supply pipe p2 between the filter 37 and the water tank 39.

The fourth water supply pipe p4 is provided with a third valve v3 for regulating the quantity of the water supplied to the ice maker 43 after being filtered by the filter 37.

Further, the third water supply pipe p3 is equipped with a mounting bracket 50 for holding an additive-storing tank assembly 60 which will be described later in more detail. The mounting bracket 50 is installed at a portion of the third water supply pipe p3 adjacent to the water tank 39, in order to help the additive stored in the additive-storing tank assembly 60 to be more easily dissolved in the water flowing through the third water supply pipe p3. For example, let us consider carbonic acid gas as an example of the additive stored in the additive-storing tank assembly 60. The cooler the solution in which the carbonic acid gas is dissolved, the higher the solubility of the carbonic acid gas. Therefore, the mounting bracket 50 is installed to a portion of the third water supply pipe p3 adjacent to the water tank 39 in which relatively cooler water flows, so that the additive stored in the additive-storing tank assembly 60 can be more effectively dissolved in the water supplied to the dispenser 41.

Referring to FIG. 3, the mounting bracket 50 has a shape of a hollow cylinder having one open end. The mounting bracket 50 has an inlet port 51*i* and an outlet port 51*o* formed through a cylindrical wall of the mounting bracket 50. The water flowing through the third water supply pipe p3 is introduced into the mounting bracket 50 through the inlet port 51*i* and then discharged out of the mounting bracket 50 through the outlet port 51*o*.

A locking flange 53 is formed at the open end of the mounting bracket 50. The locking flange 53 extends radially outward from the open end of the mounting bracket 50. The locking flange 53 has a plurality of locking hooks 55 formed at a rim of the locking flange 53. The locking hooks 55 are spaced apart a predetermined interval along the rim of the locking flange 53.

Further, a spring seat 69 is formed on a portion of an inner cylindrical surface of the mounting bracket 50. A sealing groove 57 of the mounting bracket 50 has a semi-circular sectional shape and is formed in a circle transversely along the inner cylindrical surface of the mounting bracket 50. A sealing ring 77, which will be described later in more detail, is inserted in the sealing groove 57 of the mounting bracket 50.

The additive-storing tank assembly 60 is installed in the mounting bracket 50. The additive-storing tank assembly 60 contains additive which will be dissolved in the water which flows through the third water supply pipe p3, that is, the cool water stored in the water tank 39. As shown in FIG. 3, the additive-storing tank assembly 60 includes a tank body 61, a plunger-holding tube 63, and a plunger 71.

The tank body 61 has an additive-storing space 62 defined in the tank body 61, in which the additive is stored. The additive-storing space 62 may store various additives according to users' tastes, including carbonic acid gas. Further, the additive stored in the additive-storing space 62 is dissolved in the water flowing through the third water supply pipe p3.

The plunger-holding tube 63 has a shape of a hollow cylinder which has an outer diameter corresponding to the inner diameter of the mounting bracket 50. The plunger-holding tube 63 has a length corresponding to the length of the mounting bracket 50, and both ends of the plunger-holding tube 63 are open. The plunger-holding tube 63 is disposed at one side of the tank body 61, and the hollow space inside of the plunger-holding tube 63 communicates with the additive-storing space 62. The plunger-holding tube 63 is inserted in the mounting bracket 50.

The plunger-holding tube 63 has an inlet port 63*i* and an outlet port 63*o*. The inlet port 63*i* and the outlet port 63*o* of the plunger-holding tube 63 are formed at locations corresponding to the inlet port 51*i* and the outlet port 51*o* of the mounting bracket 50, respectively. The water flowing through the third water supply pipe p3 is introduced through the inlet port 51*i* of the mounting bracket 50 and the inlet port 63*i* of the plunger-holding tube 63 into a fluid channel 73 which will be described later in more detail. While the water flows through the fluid channel 73, the additive stored in the additive-storing space 62 is added to the water. Then, the additive-containing water is discharged through the outlet port 63*o* of the plunger-holding tube 63 and the outlet port 51*o* of the mounting bracket 50 into the third water supply pipe p3.

A locking plate 65 is provided around a portion of an outer cylindrical surface of the plunger-holding tube 63 adjacent to the tank body 61. The locking plate 65 extends radially outward from the portion of the outer cylindrical surface of the plunger-holding tube 63. When the plunger-holding tube 63 is inserted and fitted in the additive-storing tank assembly 60, the locking plate 65 is inserted in the locking flange 53.

The locking plate 65 has a plurality of locking holes (not shown). The locking plate 65 has as many locking holes as the locking hooks 55, and the locking holes have shapes corresponding to the shapes of the locking hooks 55. When the locking plate 65 is inserted into the locking flange 53, the locking hooks 55 are inserted through the locking holes.

A sealing groove 67 is formed on an outer cylindrical surface of the plunger-holding tube 63. When the plunger-holding tube 63 has been inserted and fitted in the mounting bracket 50, the sealing groove 67 of the plunger-holding tube 63 is located at a position corresponding to the sealing groove 57 of the mounting bracket 50. The sealing groove 67 of the plunger-holding tube 63 also has a semi-circular sectional shape and is formed in a circle transversely around the outer cylindrical surface of the plunger-holding tube 63 while being opposed to the sealing groove 57 of the mounting bracket 50.

The spring seat 69 is formed on an inner cylindrical surface of the plunger-holding tube 63. The spring seat 69 is formed by caving a portion of the inner cylindrical surface of the plunger-holding tube 63 so that the inner diameter of the spring seat 69 is larger than the inner diameter of the plunger-holding tube 63. A coil spring 79, which will be described later in more detail, is seated in the spring seat 69.

The plunger 71 has a shape of a cylinder having an outer diameter corresponding to the inner diameter of the plunger-holding tube 63. The plunger 71 is longer than the plunger-holding tube 63. The plunger 71 is inserted in the plunger-holding tube 63 in such a manner that the plunger 71 is movable in a longitudinal direction in the plunger-holding tube 63.

More specifically, before the plunger-holding tube 63 is fitted in the mounting bracket 50, a portion of the plunger 71 protrudes out of one end of the plunger-holding tube 63, which is located at the opposite side of the tank body 61, that is, at the right end of the plunger-holding tube 63 in FIG. 3. While the plunger-holding tube 63 is inserted and fitted in the mounting bracket 50, the portion of the plunger 71 is pushed leftward in FIG. 3 by the closed end of the mounting bracket 50.

The fluid channel 73 is formed in a shape of the letter "T" in the plunger 71. The fluid channel 73 selectively interconnects the additive-storing space 62 with the inlet port 63*i* and the outlet port 63*o* of the plunger-holding tube 63. That is, only when the plunger 71 is located at a predetermined position in the plunger-holding tube 63, the additive-storing space 62 communicates with the inlet port 63*i* and the outlet port 63*o* of the plunger-holding tube 63 through the fluid channel 73. At this time, the three ends of the fluid channel 73 are connected to the additive-storing space 62, the inlet port 63*i* of the plunger-holding tube 63, and the outlet port 63*o* of the plunger-holding tube 63, respectively.

A guide rib 75 is provided on a portion of an outer cylindrical surface of the plunger 71. The guide rib 75 protrudes radially outward from the outer cylindrical surface of the plunger 71. When the plunger 71 is fitted in the plunger-holding tube 63, the guide rib 75 is located within the spring seat 69. When the plunger 71 moves in the longitudinal direction of the plunger-holding tube 63, the guide rib 75 moves within the spring seat 69.

The sealing ring 77 is inserted in and between the sealing groove 57 of the mounting bracket 50 and the sealing groove 67 of the plunger-holding tube 63. The sealing ring 77 seals the clearance between the mounting bracket 50 and the plunger-holding tube 63. To this end, it is preferred that the sealing ring 77 is made from a flexible material.

Meanwhile, the coil spring 79 is seated in the spring seat 69. The coil spring 79 is wound around the plunger 71. Both ends of the coil spring 79 are held by the left end of the spring seat 69 and the left surface of the guide rib 75 in FIG. 3, respectively.

The coil spring 79 applies elastic force to the plunger 71 in the rightward direction in FIG. 3, that is, the coil spring 79 pushes the plunger 71 rightward so that the fluid channel 73 is not aligned with the inlet port 63*i* and the outlet port 63*o* of the plunger-holding tube 63 and the plunger 71 blocks the inlet port 63*i* and the outlet port 63*o* of the plunger-holding tube 63. Therefore, by the elastic force provided by the coil spring 79, the fluid channel 73 is not aligned with the inlet port 63*i* and the outlet port 63*o* of the plunger-holding tube 63 and the plunger 71 blocks the inlet port 63*i* and the outlet port 63*o* of the plunger-holding tube 63.

Hereinafter, the operations of an additive-storing tank assembly and a refrigerator having the tank according to the present invention will be described.

First, a process for assembling the additive-storing tank assembly according to the present invention with the mounting bracket will be described in detail.

Before the additive-storing tank assembly 60 is assembled with the mounting bracket 50, the first valve v1 and the second valve v2 are locked, so as to prevent the water from flowing through the third water supply pipe p3, thereby preventing water leakage during the course of assembling the additive-storing tank assembly 60 with the mounting bracket 50.

In order to assemble the additive-storing tank assembly 60 with the mounting bracket 50, the plunger-holding tube 63 is inserted in the mounting bracket 50. At this time, the locking plate 65 is inserted in the locking flange 53 by passing the locking hooks 55 through the locking holes. Then, the tank body 61 is rotated a predetermined angle, so that the locking hooks 55 are engaged with the solid portions of the locking plate 65. Then, the plunger-holding tube 63, or actually the additive-storing tank assembly 60, is fixedly assembled with the mounting bracket 50 and is prevented from being unintentionally separated from the mounting bracket 50.

While the plunger-holding tube 63 is inserted into the mounting bracket 50, the plunger 71 is pushed toward the inside of the plunger-holding tube 63, that is, leftward of FIG. 3, by the inner bottom of the closed end of the mounting bracket 50. Therefore, the plunger 71 moves leftward against the elastic force of the coil spring 79 from the position at which the plunger 71 blocks the additive-storing space 62 and the inlet port 63*i* and the outlet port 63*o* of the plunger-holding tube 63. When the plunger-holding tube 63 has been completely inserted and fitted in the mounting bracket 50, the plunger 71 is located at a position at which the fluid channel 73 of the plunger 71 connects the additive-storing space 62 with the inlet port 63*i* and the outlet port 63*o* of the plunger-holding tube 63.

When the additive-storing space 62 is connected with the inlet port 63*i* and the outlet port 63*o* of the plunger-holding tube 63, the water flowing through the third water supply pipe p3 is introduced into the fluid channel 73 through the inlet port 51*i* of the mounting bracket 50 and the inlet port 63*i* of the plunger-holding tube 63. Then, the water flowing through the fluid channel 73 is discharged again to the third water supply pipe p3 through the outlet port 63*o* of the plunger-holding tube 63 and the outlet port 51*o* of the mounting bracket 50. At this time, additive (e.g. carbonic acid gas) stored in the additive-storing space 62 is dissolved in the water flowing through the fluid channel 73.

The clearance between the mounting bracket 50 and the plunger-holding tube 63 is blocked by the sealing ring 77. Therefore, the water introduced from the third water supply pipe p3 or the additive stored in the additive-storing space 62 is prevented from leaking out.

Next, a process of dispensing water from an additive-storing tank assembly and a refrigerator having the tank according to the present invention will be described in more detail.

When the first valve v1 is opened, water is supplied from the water source (WS) through the first water supply pipe p1 to the filter 37. The water from the water source is filtered by the filter 37, supplied through the second water supply pipe p2 to the water tank 39, and then stored in the water tank 39. The water stored in the water tank 39 is cooled and maintained at a low temperature by the cool air circulating in the fresh food compartment.

When a user operates the dispenser 41, the second valve v2 is opened, so that the water stored in the water tank 39 is supplied through the third water supply pipe p3 to the dispenser 41 which dispenses out the water. At this time, additive supplied by the additive-storing tank assembly 60 provided at the third water supply pipe p3 is dissolved in the water supplied to the dispenser 41. Therefore, the user can take and enjoy the water to which various flavors and savors are added.

In the meantime, a part of the water filtered by the filter 37 is supplied to the ice maker 43 through the fourth water supply pipe p4. The ice maker 43 produces ice by using the water supplied through the fourth water supply pipe p4. The ice produced by the ice maker 43 is supplied to the dispenser 41 so that the dispenser 41 can dispense out the ice.

The water supply to the ice maker 43 can be controlled by the third valve v3. That is to say, when it is unnecessary to produce ice by the ice maker 43, the third valve v3 may be locked, so that all of the water filtered by the filter 37 can be transferred to the water tank 39.

An additive-storing tank assembly and a refrigerator having the tank according to the present invention can provide the following effects.

According to the present invention, various additives stored in an additive-storing tank assembly are dissolved in the cool water supplied to the dispenser from the water tank.

Further, according to the present invention, an additive-storing tank assembly is disposed at a portion of a water supply pipe, from which water is discharged, that is, the portion through which relatively cooler water flows. Therefore, the present invention improves the solubility of the additive stored in the additive-storing tank assembly and enables the additive to be more effectively dissolved in the water.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An additive-storing tank assembly, comprising:

a tank body having an additive-storing space defined in the tank body, wherein the additive-storing space is configured to store an additive;

a plunger-holding tube provided at one side of the tank body configured to connect the additive-storing space with a water supply pipe that supplies water to a dispenser of a refrigerator;

an opening and closing device comprising a fluid channel formed in a plunger that selectively connects the additive-storing space with the water supply pipe through the fluid channel so that the additive stored in the additive-storing space is dissolved in the water that flows through the water supply pipe; and a mounting bracket comprising a hollow cylinder that includes one open end, wherein the mounting bracket is configured to be connected to the water supply pipe; wherein the plunger-holding tube comprises a hollow cylinder having an outer diameter and a length corresponding to an inner diameter and a length of the mounting bracket; wherein both ends of the plunger-holding tube are open and the plunger-holding tube is inserted into the mounting bracket, so that the additive stored in the additive-storing space is dissolved in the water when the water flowing through the water supply pipe passes through the plunger-holding tube; wherein the dissolved additive-containing water is then transferred to the dispenser; wherein the mounting bracket further includes an inlet port that introduces the water from the water supply pipe and an outlet port that discharges the water to the water supply pipe; wherein the plunger-holding tube includes an inlet port and an outlet port connected with the inlet port and the outlet port of the mounting bracket, respectively; and wherein the opening and closing device comprises:

the plunger comprising a cylinder having an outer diameter corresponding to an inner diameter of the plunger-holding tube, wherein the plunger is longer than the plunger-holding tube, the plunger being inserted into the plunger-holding tube so that the plunger is movable in a longitudinal direction in the plunger-holding tube, wherein the fluid channel is formed in the plunger connects the additive-storing space with the inlet port and the outlet port of the plunger-holding tube only when the plunger is located at a predetermined position in the plunger-holding tube;

an elastic member that applies an elastic force to the plunger, wherein, when the plunger-holding tube is not inserted into the mounting bracket, the plunger is pushed away from the tank body by the elastic force of the elastic member to a position in the plunger-holding tube at which the fluid channel is not connected with the inlet port and the outlet port of the plunger-holding tube and the plunger blocks the additive-storing space from the inlet port and the outlet port of the plunger-holding tube, and wherein, when the plunger-holding tube is inserted into the mounting bracket, the plunger is pushed toward the tank body against the elastic force of the elastic member by a portion of the mounting bracket, so that the additive-storing space is connected with the inlet port and the outlet port of the plunger-holding tube through the fluid channel;

a spring seat that seats the elastic member, wherein the spring seat is formed on an inner cylindrical surface of the plunger-holding tube; and a guide rib provided on a portion of an outer cylindrical surface of the plunger, so that the guide rib moves within the spring seat when the plunger moves in a longitudinal direction of the plunger-holding tube, wherein the elastic member comprises a coil spring, one end of which is held by one end of the spring seat and another end of which is held by one side of the guide rib.

2. The additive-storing tank assembly as claimed in claim 1, further comprising a locking device that prevents the plunger-holding tube from being unintentionally separated after being assembled with the mounting bracket.

3. The additive-storing tank assembly as claimed in claim 2, wherein the locking device comprises:

a locking flange that extends radially outward from the open end of the mounting bracket and includes a plurality of locking hooks formed at a rim of the locking flange, wherein the plurality of locking hooks are spaced apart by a predetermined interval along the rim of the locking flange; and a locking plate that extends radially outward from a portion of an outer cylindrical surface of the plunger-holding tube and includes a plurality of locking holes corresponding to each of the plurality of locking hooks, wherein the locking plate is inserted into the locking flange by passing the plurality of locking hooks through the plurality of locking holes and the locking plate is then rotated by a predetermined angle, so that the plurality of locking hooks are engaged with the locking plate, preventing the plunger-holding tube from being unintentionally separated from the mounting bracket.

4. The additive-storing tank assembly as claimed in claim 3, further comprising a sealing device that seals a clearance between the mounting bracket and the plunger-holding tube.

5. The additive-storing tank assembly as claimed in claim 4, wherein the sealing device comprises a sealing ring inserted in sealing grooves formed on the mounting bracket and the plunger-holding tube, that are provided opposite to each other.

6. The additive-storing tank assembly as claimed in claim 1, wherein the additive stored in the additive-storing space includes carbonic acid gas.

7. A refrigerator, comprising:

a first water supply pipe through which water supplied from an external water source flows;

a filter that filters the water supplied through the first water supply pipe;

a second water supply pipe through which the water filtered by the filter flows;

a water tank configured to store the water supplied through the second water supply pipe after being filtered by the filter;

a third water supply pipe through which the water from the water tank flows;

an additive-storing tank assembly configured to store an additive that is dissolved in the water flowing through the third water supply pipe from the water tank, wherein the additive-storing tank assembly comprises:

a tank body having an additive-storing space defined in the tank body, wherein the additive-storing space is configured to store the additive;

a plunger-holding tube provided at one side of the tank body that connects the additive-storing space with the third water supply pipe; and an opening and closing device comprising a fluid channel formed in a plunger that selectively connects the additive-storing space with the third water supply pipe through the fluid channel so that the additive stored in the additive-storing space is dissolved in the water that flows through the third water supply pipe;

a dispenser that stores and dispenses the dissolved additive-containing water supplied through the third water supply pipe;

a fourth water supply pipe through which the water filtered by the filter flows, wherein the fourth water supply pipe is branched off from the second water supply pipe; and an ice maker that supplies ice to the dispenser after producing the ice using the water supplied through the fourth water supply pipe, wherein the water supplied through the fourth water supply pipe is a part of the water filtered by the filter, wherein the additive-storing tank assembly further comprises a mounting bracket comprising a hollow cylinder that includes one open end, wherein the mounting bracket is configured to be connected to the third water supply pipe; wherein the plunger-holding tube comprises a hollow cylinder having an outer diameter and a length corresponding to an inner diameter and a length of the mounting bracket; wherein both ends of the plunger-holding tube are open; wherein the plunger-holding tube is inserted into the mounting bracket, so that the additive stored in the additive-storing space is dissolved in the water when the water flowing through the third water supply pipe passes through the plunger-holding tube, and the dissolved additive-containing water is then transferred to the dispenser; wherein the mounting bracket further includes an inlet port that introduces the water from the third water supply pipe and an outlet port that discharges the water to the third water supply pipe; wherein the plunger-holding tube includes an inlet port and an outlet port connected with the inlet port and the outlet port of the mounting bracket, respectively; and wherein the opening and closing device comprises:

the plunger comprising a cylinder that comprises an outer diameter corresponding to an inner diameter of the plunger-holding tube, wherein the plunger is longer than the plunger-holding tube, the plunger being inserted into the plunger-holding tube so that the plunger is movable in a longitudinal direction in the plunger-holding tube, and wherein the fluid channel formed in the plunger connects the additive-storing space with the inlet port and the outlet port of the plunger-holding tube only when the plunger is located at a predetermined position in the plunger-holding tube;

an elastic member that applies an elastic force to the plunger, wherein, when the plunger-holding tube is not inserted into the mounting bracket, the plunger is pushed away from the tank body by the elastic force of the elastic member to a position in the plunger-holding tube at which the fluid channel is not connected with the inlet port and the outlet port of the plunger-holding tube and the plunger blocks the additive-storing space from the inlet port and the outlet port of the plunger-holding tube, wherein, when the plunger-holding tube is inserted into the mounting bracket, the plunger is pushed toward the tank body against the elastic force of the elastic member by a portion of the mounting bracket, so that the additive-storing space is connected with the inlet port and the outlet port of the plunger-holding tube through the fluid channel;

a spring seat that seats the elastic member, wherein the spring seat is formed on an inner cylindrical surface of the plunger-holding tube; and a guide rib provided on a portion of an outer cylindrical surface of the plunger so that the guide rib moves within the spring seat when the plunger moves in a longitudinal direction of the plunger-holding tube, wherein the elastic member comprises a coil spring, one end of which is held by one end of the spring seat and another end of which is held by one side of the guide rib.

8. The refrigerator as claimed in claim 7, wherein the first water supply pipe is provided with a first valve that regulates a quantity of the water supplied to the filter from the water source.

9. The refrigerator as claimed in claim 8, wherein the third water supply pipe is provided with a second valve that regulates a quantity of the water supplied to the dispenser, in which the additive is dissolved.

10. The refrigerator as claimed in claim 9, wherein the fourth water supply pipe is provided with a third valve that regulates a quantity of the water supplied to the ice maker after being filtered by the filter.

11. The refrigerator as claimed in claim 10, wherein the additive-storing tank assembly is assembled with a portion of the third water supply pipe adjacent to the water tank.

12. The refrigerator as claimed in claim 11, further comprising a locking device that prevents the plunger-holding tube from being unintentionally separated after being assembled with the mounting bracket.

13. The refrigerator as claimed in claim 12, wherein the locking device comprises:

a locking flange that extends radially outward from the open end of the mounting bracket and includes a plurality of locking hooks formed at a rim of the locking flange, wherein the plurality of locking hooks are spaced apart by a predetermined interval along the rim of the locking flange; and a locking plate that extends radially outward from a portion of an outer cylindrical surface of the plunger-holding tube and includes a plurality of locking holes corresponding to each of the plurality of locking hooks, wherein, when the locking plate is inserted into the locking flange by passing the plurality of locking hooks through the plurality of locking holes and the locking plate is then rotated by a predetermined angle, so that the plurality of locking hooks are engaged with the locking plate, preventing the plunger-holding tube from being unintentionally separated from the mounting bracket.

14. The refrigerator as claimed in claim 13, further comprising a sealing device that seals a clearance between the mounting bracket and the plunger-holding tube.

15. The refrigerator as claimed in claim 14, wherein the sealing device comprises a sealing ring inserted in sealing grooves formed on the mounting bracket and the plunger-holding tube that are provided opposite to each other.

16. The refrigerator as claimed in claim 15, wherein the additive stored in the additive-storing space includes carbonic acid gas.

* * * * *